United States Patent [19]

Mitchell

[11] 4,178,654

[45] Dec. 18, 1979

[54] FLOOR POLISHING MACHINES

[75] Inventor: Alfred Mitchell, Montrose, Australia

[73] Assignee: Alfred Mitchell, Montrose, Australia

[21] Appl. No.: 845,677

[22] Filed: Oct. 26, 1977

[30] Foreign Application Priority Data

Nov. 29, 1976 [AU] Australia ..... PC8282

[51] Int. Cl.[2] ..... A47L 11/202

[52] U.S. Cl. ..... 15/385; 15/420

[58] Field of Search ..... 15/385, 320, 420

[56] References Cited

U.S. PATENT DOCUMENTS

| | | | |
|---|---|---|---|
| 928,456 | 7/1909 | Johnson | 15/385 X |
| 935,558 | 9/1909 | Spangler | 15/385 X |
| 2,250,177 | 7/1941 | Boccasile | 15/385 X |
| 2,415,372 | 2/1947 | Salt et al. | 15/385 X |
| 2,663,893 | 12/1953 | Percy | 15/385 X |
| 3,314,099 | 4/1967 | Otto | 15/385 |
| 3,375,540 | 4/1968 | Hyde | 15/328 X |
| 3,719,966 | 3/1973 | Lamont | 15/385 |

*Primary Examiner*—Christopher K. Moore
*Attorney, Agent, or Firm*—Harold L. Stowell

[57] ABSTRACT

The invention relates to floor polishing machines comprising a rotary brush drive means for the brush and means, such as a fan, for producing an updraught around the periphery of the brush to assist in removing particulate matter from a floor being polished.

5 Claims, 6 Drawing Figures

FLOOR POLISHING MACHINES

The present invention relates to a floor polishing machine.

In accordance with the present invention there is provided a floor polishing machine comprising a rotary brush, drive means for the brush, and means for producing, in use, an updraught around the periphery of the brush.

Preferably, the means for producing the updraught is in the form of a fan arranged to rotate when the brush is rotating. The fan may be driven directly from the drive to the brush or it may be driven through gears or belts from the drive means to the brush or by any other suitable means.

By providing means for producing an updraught around the periphery of the brush, particulate matter such as dust lying on the area of floor or other surface being polished, can be removed therefrom.

It has been found that the floor polisher of the present invention may be operated without a vacuum motor and in this case the floor polisher is very quiet in operation which makes it extremely suitable for use in hospitals and other environments where noise is disruptive.

The present invention also provides a skirt member for use with a floor polishing machine comprising an annular conduit arranged to be in communication with a vacuum motor and containing a plurality of apertures for collecting particulate matter from a floor.

The present invention will now be described further by way of example with reference to the accompanying drawings, in which.

Figure 1:
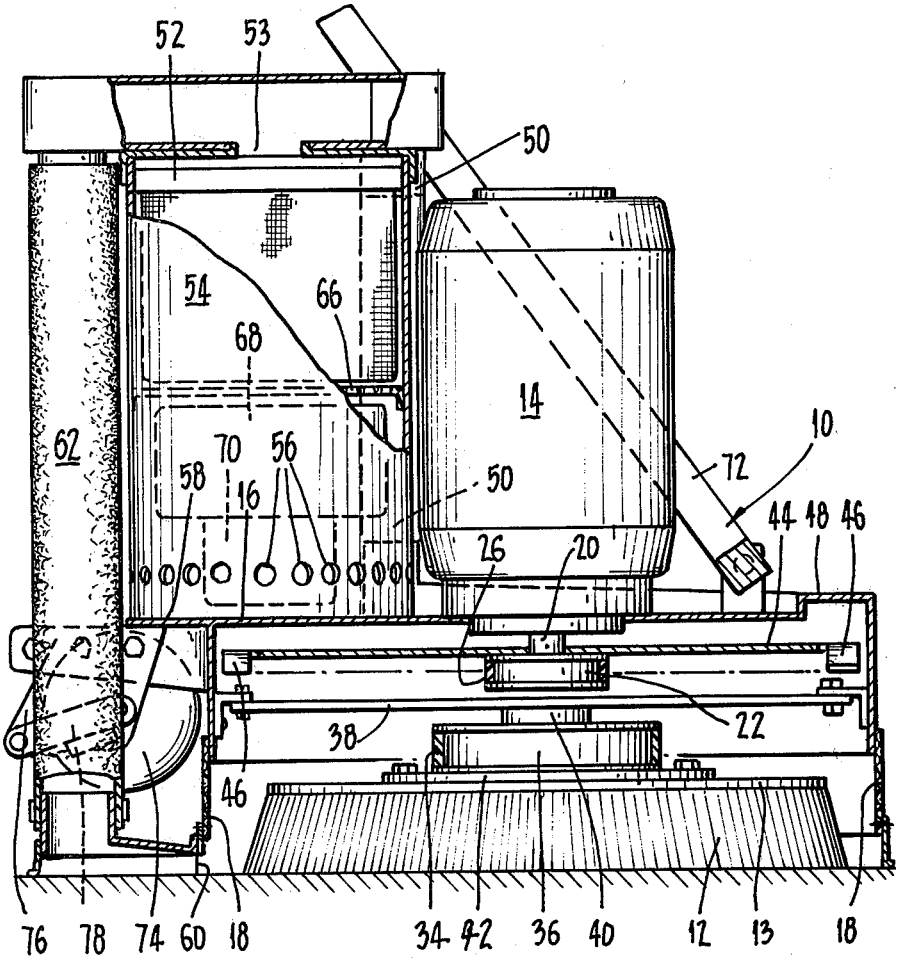
FIG. 1 is a side elevation partially in section of a floor polisher in accordance with the present invention.
Figure 2:
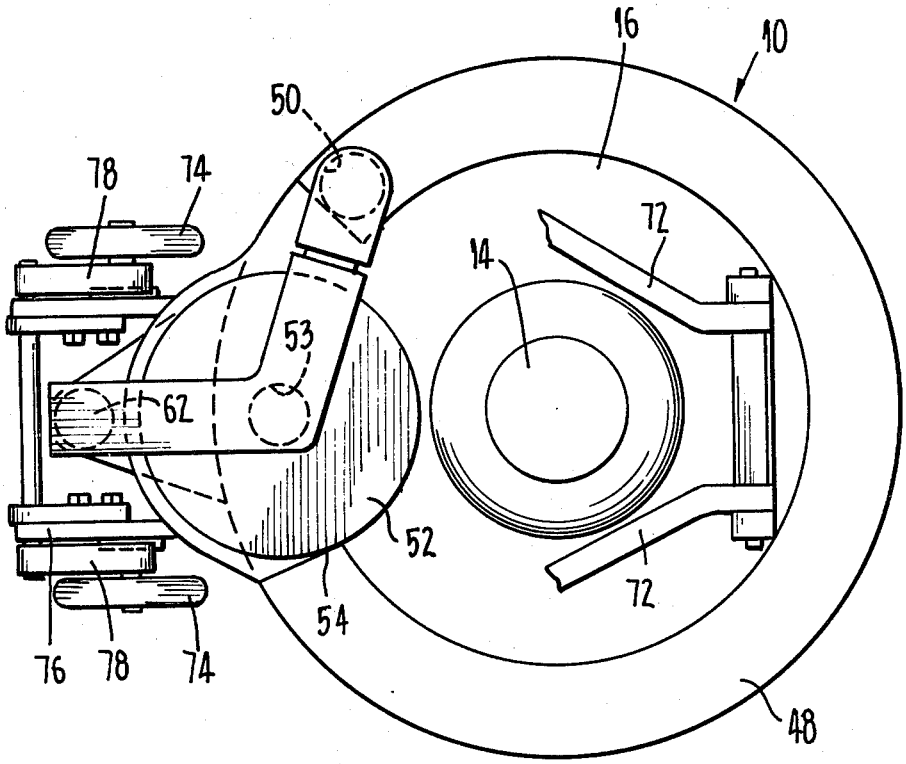
FIG. 2 is a plan view of the floor polisher of FIG. 1.
Figure 3:
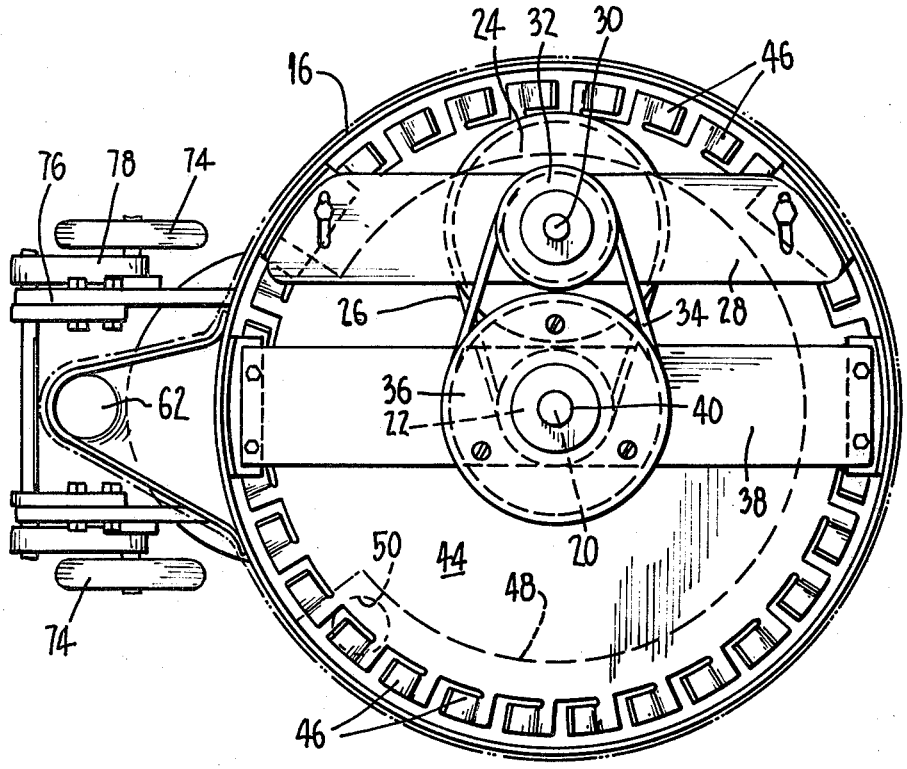
FIG. 3 is an underneath view of the floor polisher of FIG. 1 with parts deleted for clarity.

In FIGS. 1 to 3 of the drawings, there is shown a floor polisher 10 comprising a rotary brush 12 with a backing member 13 having a plurality of ground engaging bristles bonded thereto. The brush 12 is connected through a drive train to an electric motor 14. The motor 14 is arranged to drive the brush 12. The brush 12 is located within a housing 16 having a depending ground engaging skirt 18.

The drive train for the brush 12 comprises a shaft 20 extending from the motor 14 and connected at its lower end as seen in FIG. 1, to a pulley wheel 22. The pulley wheel 22 is connected to a larger diameter pulley wheel 24 by means of a driving belt 26 (see FIG. 3 in which the brush 12 has been omitted for greater clarity) to provide a first reduction in the drive from the motor 14. The pulley wheel 24 is mounted on a plate 28. A shaft 30 extends rotatably through the plate 28 and drivingly connects the pulley wheel 24 to a further pulley wheel 32 of a diameter similar to that of the pulley wheel 22. The pulley wheel 32 is connected by means of a driving belt 34 to a larger diameter pulley wheel 36 having a diameter similar to that of the pulley wheel 24, to provide a second reduction in the drive from the motor 14. The pulley wheel 36 is rotatably mounted on a plate 38 by means of a shaft 40.

As can be seen in FIG. 1, the pulley wheel 36 is firmly and rigidly connected to the upper surface of the brush 12 by means of bolts extending through a plate 42, which is welded to the pulley wheel 36, into the backing member 13 of the brush 12.

A fan member 44 is rigidly mounted on the drive shaft 20 from the motor 14 just about the pulley wheel 20. The fan member 44 is circular in shape and has a plurality of turned-down (as seen in FIG. 1) blade members 46 formed around its entire periphery.

Further, the housing 16 has an upstanding channel 48 extending around a major proportion of its periphery. The channel 48 is of gradually increasing height up to its termination at a vertical conduit 50. The conduit 50 communicates through an opening 53 with a container 52 arranged to receive and collect dust and other particulate matter such as by means of for example, a hessian bag. The container 52 is located within a vertical cylindrical housing 54 having a horizontal row of air outlet holes 56 adjacent its low end. Further, the housing 54 is mounted in part on a portion of the upper surface of the housing 16 not having the channel 48 and in part on a plate 58.

The parts of the floor polishing machine described above operate as follows. The electric motor 14 is energised so causing the shaft 20 to rotate at the same speed as the motor 14. The rotation of the shaft 20 causes the fan 44 to rotate at the same speed and the brush 12 to rotate at a reduced speed as determined by the arrangement of pulleys and belts described above.

The rotation of the brush 12 causes the bristles thereof to rub against the floor or other surface with which they are in engagement and so to polish the same, usually with the aid of a polishing medium which has been previously applied.

Further, the simultaneous rotation of the fan 44 causes an updraught to be created around the periphery of the brush 12. The fan 44 is so arranged that at operating speed the updraught is sufficient to lift particulate matter such as dust from the floor or other surface for removal through the conduit 50. The channel 48 is provided to enhance the action of the fan 44 and has a cyclone effect in the movement of the particulate matter into and up the conduit 50.

The particulate matter is fed from the conduit 50 into the container 52 where it is collected for subsequent disposal. The air flow passes through the collection medium such as the hessian bag, to exit through the holes 56.

The arrangement described above satisfactorily disposes of particulate matter lying on the surface being polished. Further, since no vacuum motor is required it is particularly quiet in operation.

However, the effect of the apparatus described above may optionally be supplemented by the arrangement described below.

An aperture 60 is provided in the skirt 18. This aperture is in communication with a vertical conduit 62 which leads into the container 52 through the opening 53 as does the conduit 50. In this arrangement the container 52 is located within the upper part of the vertical cylindrical housing 54. The lower part of the cylindrical housing 54 is separated from the upper part by a perforated plate 66, and contains an extraction fan 68 driven by a motor 70. In this arrangement the extraction fan 68 is actuated by the motor 70 so as to produce an updraught in the conduit 62. This in turn causes a horizontal suction effect through the aperture 60 and removes particulate matter from a portion of the surface adjacent the aperture 60.

However, it is to be noted that this arrangement only removes particulate matter from a small portion of the area between the brush 12 and the skirt 18 whereas the fan 44 removes particulate matter from around the whole periphery of the brush 12.

The floor polishing machine 10 is further provided with a conventional driving handle 72 and a pair of conventional ground engaging wheels 74 retractably mounted on a mounting plate 76 by means of pivotally mounted arms 78.

The fan 44 is typically driven at a speed in the range from 600–4500 rpm to generate sufficient updraught for satisfactory removal of particulate matter.

Figure 4:
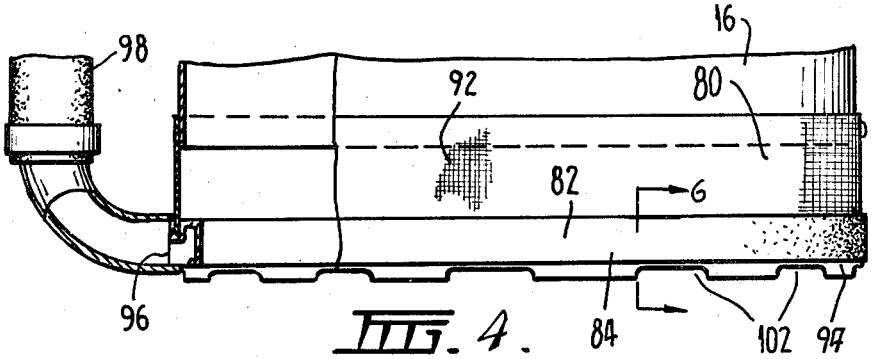
FIG. 4 is a side elevation partially broken away of a novel skirt which may be used in conjunction with the floor polisher of the present invention.
Figure 6:
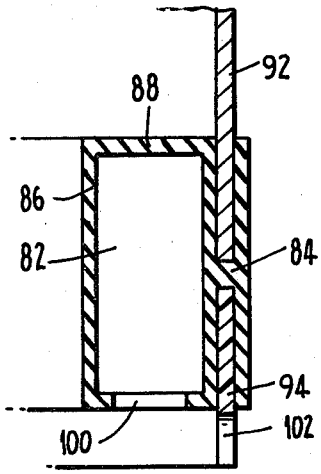
FIG. 6 is a section taken along the line 6—6 of FIGS. 4 and 5.
Figure 5:
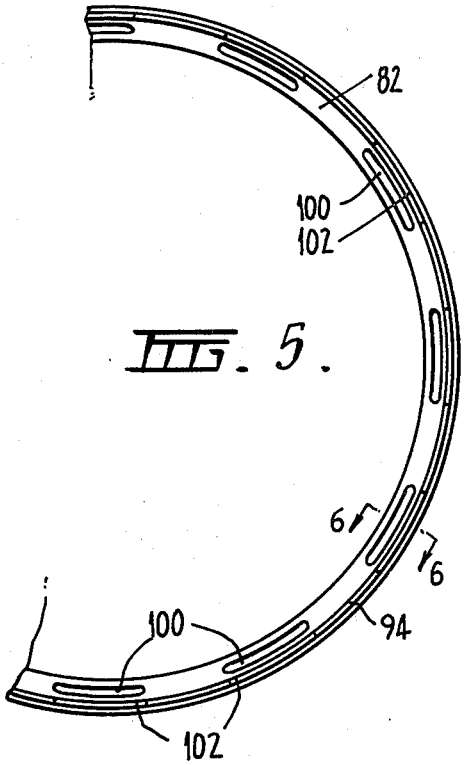
FIG. 5 is an underneath view of the skirt of FIG. 4.

In FIGS. 4 to 6 of the accompanying drawings there is shown a novel skirt 80 which may be used to replace the skirt 18 of the embodiment of the invention illustrated in FIGS. 1 to 3. The skirt 80 depends from a housing 16 as shown in FIG. 1.

The skirt 80 comprises an annular conduit 82 comprising an outer vertical wall 84, and inner vertical wall 86 and horizontal upper and lower walls 88 and 90 respectively.

A cylindrical member 92 is attached to the underside of the housing 16. Further, the outer vertical wall 84 of the annular conduit 82 contains an upward facing slot which receives the lower portion of the cylindrical member 92. The cylindrical member 92 is bonded to the annular conduit 82 by any convenient means such as by adhesive. The outer vertical wall also contains a downward facing slot which receives the upper portion of a ground engaging member 94. The ground engaging member 94 is also bonded to the annular conduit 82 by any convenient means such as by adhesive.

The annular conduit 82 is connected at one point to a vacuum motor such as motor 70 shown in FIG. 1 through an opening 96 in the outer vertical wall 84 and a vertical conduit 98.

As can best be seen in FIG. 5 the lower horizontal wall 90 of the annular conduit 82 contains a plurality of spaced apertures 100. Further, the ground engaging member contains cut away portions 102 at locations corresponding to the apertures 100.

The annular member 82 is preferably formed of a flexible material such as rubber or non-rigid plastics material to enable the skirt 80 to conform closely to the contours of the floor when in use. The ground engaging member 94 is preferably formed of a relatively hard material such as polypropylene or polyethylene to prevent undue wear in use.

In operation, when the vacuum motor is energised a draught is produced throughout the annular conduit 82. This causes air to be sucked into the annular conduit 82 through the apertures 100. The air entering the apertures 100 comes partially from the interior of the skirt 80 and partially through the cut away portions 102 in the ground engaging member 94.

When in use with the floor polishing machine of FIGS. 1 to 3, the skirt 80 in conjunction with the vacuum motor but independently of the fan member 44, causes particulate matter lying on the floor to be sucked through the apertures 100 into the annular conduit 82 and thence through the opening 96 into the vertical conduit 98 for collection in conventional manner. This enhances the operation of the apparatus of FIGS. 1 to 3 in that the floor is cleaned even more efficiently whilst being polished.

Modification and variations such as would be apparent to a skilled addressee are deemed within the scope of the present invention. For example, the fan 44 could be provided with wider blades 46 if desired. Further the fan 44 could be driven by gears or belts rather than a direct drive as shown. Still further, for increased updraught a two stage fan or a multiple stage fan or fans could be used. Also, the annular conduit 82 can have any suitable cross-section. For example, it may be square or circular as well as rectangular as shown in the drawings.

We claim

1. A floor polishing machine comprising a housing having an upper substantially horizontal surface and a substantially vertical wall extending around the periphery of the upper surface, a ground engaging skirt depending from the vertical wall and being provided with air inlet means for admitting air to the interior of the housing, a rotary polishing means located within the housing, drive means arranged to rotate the polishing means in a horizontal plane, a fan located within the housing and arranged to be rotated in a horizontal plane when the polishing means is rotated, means forming a channel in a major portion of the periphery of the housing and open to the upper interior of the housing, the formed channel being of gradually increasing thickness to provide a gradually larger zone in cross-sectional area, and a particulate matter collection means in communication with the channel at its point of greatest cross-sectional area, whereby, when the polishing means is rotated the simultaneous rotation of the fan produces an updraught around the entire periphery of the polishing means so as to direct particulate matter into the channel in the periphery of the housing for removal through the particulate matter collection means.

2. A floor polishing machine as claimed in claim 1, in which the fan is driven directly from the drive means for the polishing means.

3. A floor polishing machine as claimed in claim 1, in which the fan comprises a circular plate having a plurality of downturned blade members around its entire periphery, said blade members being located outwardly of the polishing means but in line with the channel in the housing.

4. A floor polishing machine as claimed in claim 1, in which the skirt contains an opening adjacent floor level in communication with a motor driven suction means.

5. A floor polishing machine as claimed in claim 1, in which the air inlet means of the skirt is in the form of a plurality of cut-away portions adjacent the floor.

* * * * *

US004178654B1

REEXAMINATION CERTIFICATE (1637th)

United States Patent [19] [11] B1 4,178,654

Mitchell [45] Certificate Issued Feb. 4, 1992

[54] FLOOR POLISHING MACHINES

[76] Inventor: Alfred Mitchell, Montrose, Australia

Reexamination Request:
No. 90/002,155, Oct. 4, 1990

Reexamination Certificate for:

| | |
|---|---|
| Patent No.: | **4,178,654** |
| Issued: | **Dec. 18, 1979** |
| Appl. No.: | **845,677** |
| Filed: | **Oct. 26, 1977** |

[30] Foreign Application Priority Data

Nov. 29, 1976 [AU] Australia ..... PC8282

[51] Int. Cl.[5] ..... A47L 11/202
[52] U.S. Cl. ..... 15/385; 15/420
[58] Field of Search ..... 15/385, 420

[56] References Cited

U.S. PATENT DOCUMENTS

| | | | |
|---|---|---|---|
| 928,456 | 7/1909 | Johnson | 15/385 X |
| 935,558 | 9/1909 | Spangler | 15/385 X |
| 1,093,820 | 4/1914 | Beach | 15/385 X |
| 1,677,533 | 7/1928 | Staehle | 15/385 X |
| 1,763,365 | 6/1930 | Nobbs | 15/49.1 |
| 2,250,177 | 7/1941 | Boccasile | 15/385 X |
| 2,251,442 | 8/1941 | Emmons | 51/177 |
| 2,268,863 | 1/1942 | Emmons | 15/385 X |
| 2,415,372 | 2/1947 | Salt et al. | 15/385 X |
| 2,663,893 | 12/1953 | Percy | 15/385 X |
| 2,933,752 | 4/1960 | McLennon | 15/385 X |
| 2,957,295 | 10/1960 | Brown | 56/13.4 |
| 3,049,853 | 8/1962 | Horner et al. | 56/13.4 |
| 3,064,292 | 11/1962 | Fillery | 15/385 X |
| 3,118,267 | 1/1964 | Shaw | 56/17.5 |
| 3,157,009 | 11/1964 | Barkley | 51/273 |
| 3,157,015 | 11/1964 | Russell et al. | 56/12.7 |
| 3,314,099 | 4/1967 | Otto | 15/385 |
| 3,375,540 | 4/1968 | Hyde | 15/328 X |
| 3,413,783 | 12/1968 | Gordon | 56/320.2 |
| 3,453,812 | 7/1969 | Heidner et al. | 56/320.2 |
| 3,568,421 | 3/1971 | Smith et al. | 56/255 |
| 3,719,966 | 3/1973 | Lamont | 15/385 |
| 4,148,110 | 4/1979 | Moen | 15/385 |

FOREIGN PATENT DOCUMENTS

| | | |
|---|---|---|
| 206309 | 4/1956 | Australia . |
| 225948 | 6/1958 | Australia . |
| 414936 | 8/1969 | Australia . |
| 1239448 | 11/1967 | Fed. Rep. of Germany . |
| 723168 | 9/1931 | France . |
| 289811 | 9/1928 | United Kingdom . |
| 889397 | 2/1962 | United Kingdom . |
| 949158 | 2/1964 | United Kingdom . |
| 1310314 | 3/1973 | United Kingdom . |

OTHER PUBLICATIONS

The Floorboss MKII-Vacuum Polishing Machine Advertising (pre-1976).
Progress Floor Maintenance Equipment Information (pre-1976).
The Way Things Work-An Illustrated Encyclopedia of Technology 1963.
Fans-Commercial Types of Fan Information 1935.
Centrifugal and Axial Flow Pumps-2nd Edition 1948.
Centrifugal and Other Rotodynamic Pumps-3rd Edition 1966.

*Primary Examiner*—Chris K. Moore

[57] ABSTRACT

The invention relates to floor polishing machines comprising a rotary brush drive means for the brush and means, such as a fan, for producing an updraught around the periphery of the brush to assist in removing particulate matter from a floor being polished.

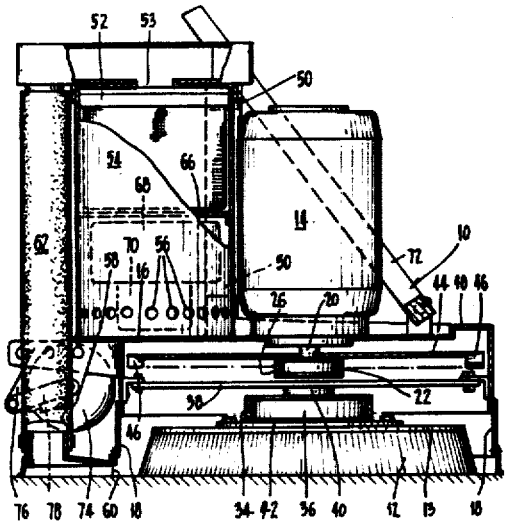

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-5 is confirmed.

* * * * *